United States Patent [19]

Leimbach

[11] Patent Number: 4,750,334

[45] Date of Patent: Jun. 14, 1988

[54] BALANCED THERMOSTATIC EXPANSION VALVE FOR REFRIGERATION SYSTEMS

[75] Inventor: John G. Leimbach, Crestwood, Mo.

[73] Assignee: Sporlan Valve Company, St. Louis, Mo.

[21] Appl. No.: 30,336

[22] Filed: Mar. 26, 1987

[51] Int. Cl.[4] ..... F25B 41/04

[52] U.S. Cl. ..... 62/225; 236/92 B; 251/282

[58] Field of Search ..... 236/92 B, 92 R; 62/225; 251/282

[56] References Cited

U.S. PATENT DOCUMENTS

| | | | |
|---|---|---|---|
| Re. 30,115 | 10/1979 | Herd et al. | 251/282 X |
| 762,861 | 6/1904 | Keller | 251/282 X |
| 2,306,768 | 12/1942 | Wile | 236/92 R X |
| 2,755,025 | 7/1956 | Boles | 236/92 B |
| 3,389,796 | 6/1968 | Frala et al. | 251/282 X |
| 3,699,778 | 10/1972 | Orth | 236/92 B X |
| 3,960,358 | 6/1976 | Vollmer et al. | 251/282 X |
| 4,621,767 | 11/1986 | Denneny, Jr. et al. | 236/92 R |

*Primary Examiner*—William E. Tapolcai
*Attorney, Agent, or Firm*—Cohn, Powell & Hind

[57] ABSTRACT

A thermostatic expansion valve particularly for use in a refrigeration system in which the refrigeration system includes a compressor, condenser, and evaporator operatively interconnected. The expansion valve includes a diaphragm for sensing a capillary pressure and a plurality of push rods for communicating the capillary pressure to a spring-biased valve member operatively associated with a valve seat. A piston in communication with the diaphragm has one end located in an inlet chamber and responds to an inlet chamber pressure. The piston, diaphragm, push rods and spring-biased valve member cooperate to provide a balanced flow of a refrigerant through the expansion valve without the piston or push rods substantially restricting or obstructing refrigerant flow through the expansion valve.

9 Claims, 1 Drawing Sheet

BALANCED THERMOSTATIC EXPANSION VALVE FOR REFRIGERATION SYSTEMS

BACKGROUND OF THE INVENTION

This invention relates generally to improvements in a thermostatic expansion valve for refrigeration systems and more particularly to a balanced valve assembly including in combination a piston sensing an inlet chamber pressure, one or more pusher rods communicating a capillary line pressure to a valve member and a biasing member biasing the valve member to a closed position so as to provide balanced refrigerant flow through a valve port in the expansion valve in response to changes in refrigeration system operating conditions, including refrigeration load and refrigerant pressure drop across the valve port.

Balanced thermostatic expansion valves have been used in refrigeration systems for many years to automatically control the flow of refrigerant from the high pressure side of a refrigeration system, that is, the discharge from the condenser unit. Most balanced thermostatic expansion valves presently in use incorporate a valve motor or diaphragm and operate in response to a differential pressure across the diaphragm. The differential pressure is partially a function of a superheat of a vaporized refrigerant as it leaves the evaporator or as it is commonly referred to, evaporator superheat.

Conventional refrigeration valves, such as may be found in U.S. Pat. No. 3,742,722 for a Thermostatic Expansion Valve for Refrigeration Systems, U.S. Pat. No. 3,738,573 for an Expansion Valve, and U.S. Pat. No. 2,786,336 for a Refrigerant Expansion Valve Mechanism, employ a stem associated with a valve motor or a diaphragm wherein the valve motor or diaphragm responds to a capillary pressure. The capillary pressure is generally a function of the evaporator superheat.

During operation of the refrigeration system the evaporator superheat and pressure of the refrigerant as it leaves an evaporator outlet will vary as a result of changing load conditions and a change in the refrigerant pressure drop across the valve port. A change in the discharge pressure of the refrigerant leaving the condenser, or head pressure as it is also referred to, due to the difference between summer and winter operation of the refrigeration system, as a result of a change in the ambient temperature of the condenser, may vary as much as from fifty (50) to three hundred (300) pounds per square inch.

The result of such a variation is a change in evaporator superheat and a change in a refrigerant pressure difference across the expansion valve. The change in the refrigerant pressure difference across the expansion valve changes the amount of refrigerant flow through the expansion valve and changes evaporator superheat.

An increase in condenser discharge pressure or head pressure at or above a predetermined condenser pressure limit may affect the expansion valve in a number of ways. It may result, for example, in an increased refrigerant pressure drop across the valve port and require a reduced valve opening to maintain refrigerant flow and a constant superheat at the evaporator outlet.

In most expansion valves the refrigerant flows in the same direction that the valve port opens. When the differential pressure of the refrigerant across the valve port varies there is a variation in the forces which operate the expansion valve. These forces, due to an unbalanced pressure condition within the expansion valve, add to the force corresponding to caplillary pressure on the diaphragm and are opposed by the counterforce of the biasing member, such as a valve spring, tending to close the valve port and reduce refrigerant flow. A balance between the forces acting on the diaphragm plus unbalanced pressure across the valve port and the biasing member determines the amount of refrigerant flow through the expansion valve and the evaporator superheat.

The thermostatic expansion valve of the present invention solves these and other problems in a manner not disclosed in the known prior art.

SUMMARY OF THE INVENTION

The thermostatic expansion valve of the present invention generally provides means for controlling refrigerant flow to the evaporator of a refrigeration system which generally includes a compressor, condenser and evaporator operatively interconnected and a thermostatic expansion valve located between a condenser outlet (high pressure side) and an evaporator inlet. The thermostatic expansion valve generally includes a valve body, an inlet chamber, an outlet chamber and means for separating the inlet chamber from the outlet chamber. An expansion valve inlet connects the inlet chamber with one refrigerant line connected to the high pressure refrigerant side. An expansion valve outlet connects the expansion valve to another refrigerant line running to an evaporator inlet. Means are provided for controlling the flow of the refrigerant through the expansion valve.

Means for defining a valve port are provided such that the valve port defining means operatively receives the flow controlling means. The valve port defining means also provides communication between the inlet chamber and the outlet chamber for the flow or refrigerant through the expansion valve. A biasing member biases the flow controlling means towards a closed position thereby tending to reduce the flow of refrigerant through the expansion valve.

A flexible motor element may be carried by the valve body and operatively connected to the flow controlling means so as to tend to move the flow controlling means between an open position and a closed position thereby increasing or decreasing the flow of refrigerant through the expansion valve.

Means for sensing a refrigerant temperature at an evaporator outlet are provided and subject one side of the flexible motor element to a vapor pressure, also referred to as the capillary pressure. The vapor pressure or capillary pressure is a function of the refrigerant temperature at the evaporator outlet.

A first means for communicating the inlet chamber pressure to another and opposing side of the flexible motor element is provided and tends to resist the movement of the flexible motor element. The first communicating means operates without substantially restricting or obstructing refrigerant flow through the expansion valve. In a preferred embodiment this inlet chamber pressure communication means is a piston. The purpose of the piston is to counterbalance the force of the refrigerant flow which tends to open the valve. The piston exerts an equal opposing force against the diaphragm.

A second communicating means is provided intermediate the flexible motor element and the flow controllng means.

The differential pressure across the flexible motor element, which is proportional to the superheat of the refrigerant leaving the evaporator is opposed by a biasing member such as a spring. A force is produced by the high pressure refrigerant against the flow controlling means, tending to open up the valve port against the force of the biasing member.

The force of the high pressure refrigerant against the flow controlling means is the one which the first communicating means of the present invention neutralizes.

It is an aspect of this invention that the expansion valve provides for a substantial cancellation of an undesirable change in superheat due to a change in head pressure.

It is another aspect of this invention that the expansion valve provides for balanced refrigerant flow without substantially restricting or obstructing refrigerant flow through the expansion valve.

It is another aspect of this invention that the expansion valve provides the first communicating means for communicating inlet chamber pressure to the other side of the flexible motor element, which means may have a desired area to provide either an exactly balanced valve port area or underbalance or overbalance for a corresponding change in refrigerant pressure drop across the valve port.

It is yet another aspect of this invention that the expansion valve includes sealing means of TEFLON or the like for preventing leakage of high pressure refrigerant from the inlet chamber to the other side of the flexible motor element.

BRIEF DESCRIPTION OF THE DRAWINGS

Further features and characteristics of the present invention can be seen from the figures and descriptions below in which.

DESCRIPTION OF THE PREFERRED EMBODIMENTS

Figure 1:
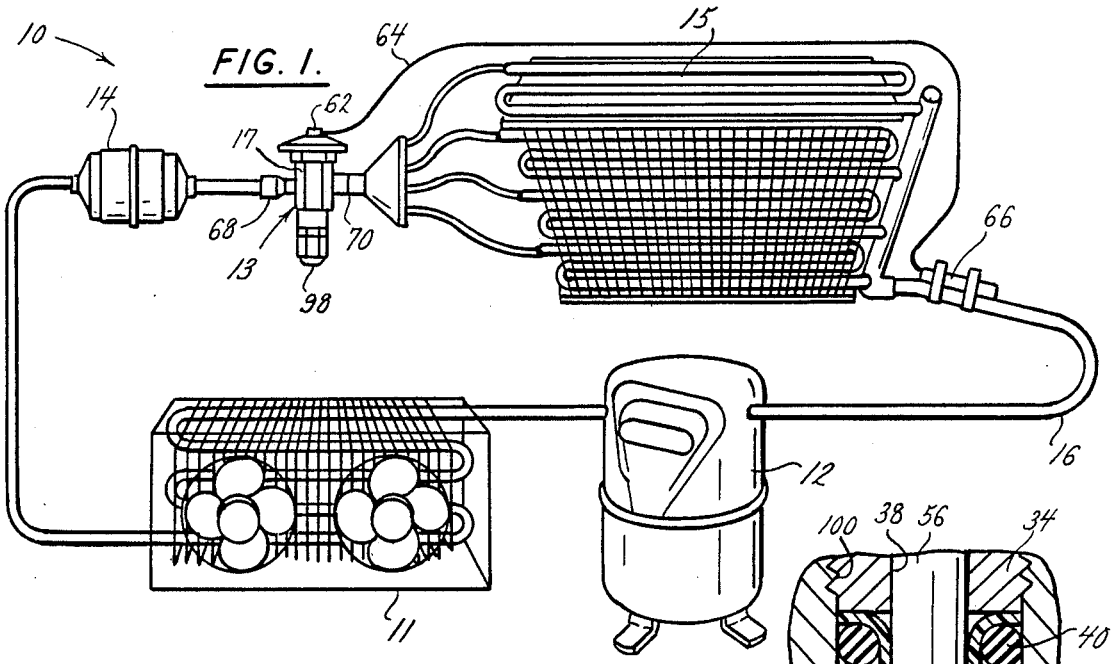
FIG. 1 is a diagram showing a refrigeration system and the connection of a thermostatic expansion valve in such system.

Referring now by characters of reference to the drawing, and first to the refrigeration system diagram of FIG. 1, it will be understood that a refrigeration system 10 includes a condenser 11 from which refrigerant flows through a suitable refrigerant line to a receiver 14 and then to a thermostatic expansion valve 13. The expansion valve is connected to an inlet of an evaporator 15. A suction line 16 connects an evaporator outlet with a compressor 12 to complete the refrigeration circuit. The expansion valve 13, as illustrated, includes an inlet 68 and an outlet 70 connecting expansion valve 13 to associated refrigerant lines.

Figure 2:
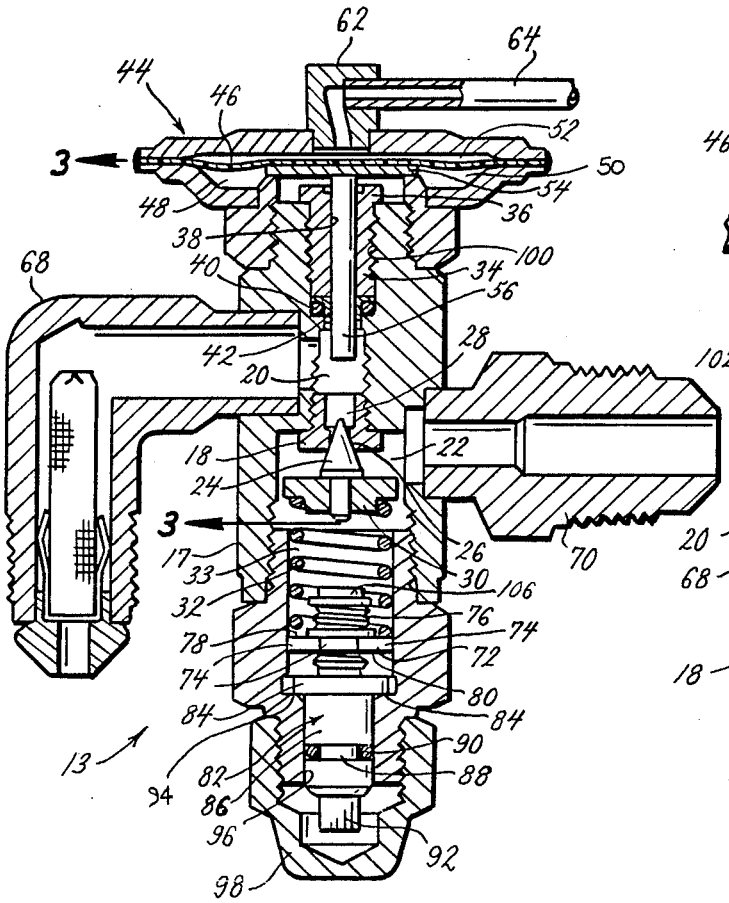
FIG. 2 is a cross sectional view of a thermostatic expansion valve of the present invention.

Referring now by characters of reference to an expansion valve illustrated in FIG. 2, it will be understood that the expansion valve includes a body 17 formed from threadably connected upper and lower portions within which is a threaded element 18 intermediate an inlet chamber 20 and an outlet chamber 22 formed within the valve body. Threaded element 18 provides means for separating the inlet chamber from the outlet chamber. A refrigerant flow controlling means is provided in a preferred embodiment by a valve member 24 which operatively cooperates with a valve seat 26. The valve seat further defines a valve seat port 28.

Figure 3:
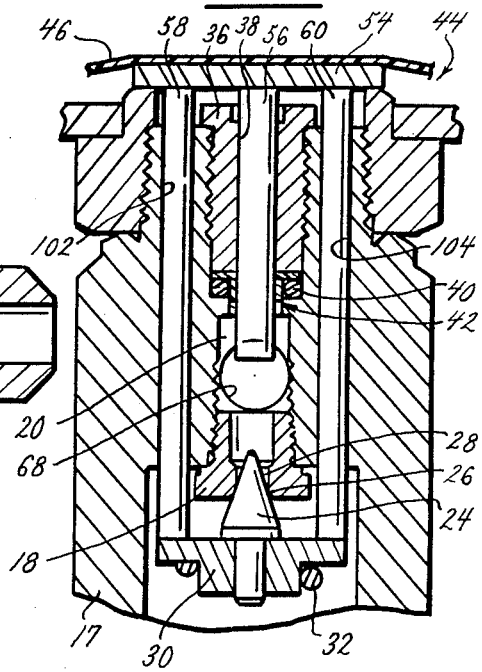
FIG. 3 is an enlarged cross section view of a piston and plurality of push rods of one embodiment of the present invention.

As illustrated in FIGS. 2 and 3, a preferred embodiment further includes a valve guide member 30 located within the outlet chamber and biased towards a closed position of the valve member 24 with respect to valve seat 26 and valve seat port 28 by a biasing member, or spring 32 in the preferred embodiment, mounted in a bore 33 provided in the lower portion of the valve body 17.

Also adjacent to the inlet chamber 20 is a threaded guide member 34 threadably engaged with the body of the valve in a passage or threaded bore 100 provided in the upper portion of valve body 17. In the preferred embodiment the threaded guide member includes a flange 36 cooperating with the valve body to limit threaded engagement between the threaded guide member 34 and the upper portion of valve body 17. The threaded guide member 34 includes and defines an axial bore 38 which provides another passage between a diaphragm chamber 48 and the inlet chamber 20 when the threaded guide member is threadably engaged with the threaded bore as illustrated in FIG. 3.

A first O-ring 40 and a cup seal 42 may be located in sealing relationship with the threaded guide member so as to prevent direct communication between the inlet chamber 20 and a first compartment 50 of diaphragm chamber 48 when a piston 56 is slidably received by the axial bore 38. Piston 56, which is operatively connected to valve member 24 for movement with the valve member 24, is movable within the bore and constitutes a first communicating means which responds to a pressure differential between inlet chamber 20 and the capillary pressure that is a function of evaporator superheat as will be further described. The piston does not substantially restrict or obstruct refrigerant flow through the inlet chamber.

Figure 4:
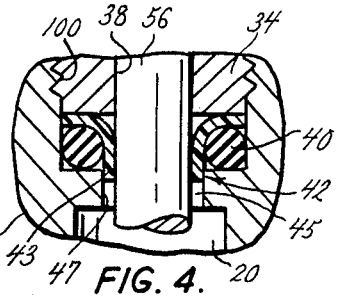
FIG. 4 is an enlarged partial cross section of a piston and seal arrangement of one embodiment of the present invention.

Referring now by characters of reference to the drawing FIG. 4, it will be seen that the threaded guide 34 is threadably received by the threaded bore 100 in the upper portion of the valve body 17. The first O-ring 40 forms a seal between the threaded guide 34 and the upper portion of valve body 17. The cup seal 42 prevents leakage between the head pressure and the evaporator pressure and is preferably a TEFLON material since, among its other properties, TEFLON has a very low coefficient of friction and can be formed in the desired cup shape.

The cup seal 42 is in cooperative sealing relationship with the piston and in the described embodiment is held between the first O-ring 40 and the upper portion of valve body 17 as shown in FIG. 4. A depending portion 43 of the cup seal 42 is pressed against the surface of piston 56 by the pressure of the refrigerant in an annular void 45 between the depending portion 43 and an opposing surface 47 of the upper portion of valve body 17. Because of the very low coefficient of friction of TEFLON the piston 56 is free to move in axial bore 38 relative to the TEFLON cup 42 without deforming the cup and destroying the seal between the cup and the piston. The greater the pressure of the refrigerant in contact with the cup seal 42 the better the seal. It will be understood that any material equivalent to TEFLON may also be used to the cup seal.

A valve motor may be operatively associated with the expansion valve as illustrated in FIG. 2. In the preferred embodiment the valve motor includes a casing structure 44 threadably attached to the valve body 17.The casing structure includes a diaphragm 46 constituting a flexible motor element held within the diaphragm chamber 48. The diaphragm divides the chamber into the first compartment 50 and a second compartment 52 and includes one side and another opposing side disposed in the diaphragm chamber compartments. A follower member 54 attached to the diaphragm on the compartment 50 side of the diaphragm is located intermediate the piston 56 and the diaphragm 46 as illustrated in FIG. 2. The use of the follower 54 will be required generally since diaphragm material is relatively flexible. The follower functions to reinforce the diaphragm and, as illustrated in the drawings, acts as a stop for movement of the diaphragm and therefore the piston. As clearly illustrated in the drawings one end of piston 56 responds to inlet chamber pressure but does not substantially extend into inlet chamber 20 and does not substantially restrict or obstruct refrigerant flow through the expansion valve while still sensing inlet chamber pressure as desired. As previously described, the other end of piston 56 is operatively associated with the diaphragm.

A fitting 62, operatively associated with the casing structure 44, provides capillary communication means for applying a capillary pressure to the second compartment 52 of the diaphragm chamber 48. The capillary pressure further communicates through a capillary tube 64 from a bulb 66. Preferrably the bulb is attached to the suction line 16 of the refrigeration system. The bulb will be located such that it senses a suction line temperature and therefore the superheat of the refrigerant leaving the evaporator. The capillary pressure applied to the second compartment side of diaphragm 46 is in the form of a vapor pressure that is a function of the evaporator discharge superheat.

A second communicating means may be provided intermediate the diaphragm 46 and the biasing member 32 in order to communicate a difference between the capillary pressure and the inlet chamber pressure to the biasing member. The second communicating means is preferably a rigid member or members. Referring now by characters of reference to FIG. 3 it will be understood that the second communicating means of the expansion valve of the present invention described herein may include at least one rigid member or push rod. In the preferred embodiment a first push rod 58 and a second push rod 60 extend between the follower 54 and valve guide 30. Push rods 58, 60 extend through a first axial passage or bore 102 and a second axial passage or bore 104 in the valve body 17. Preferably the first and second push rods and the piston 56 are parallel to each other. The push rods, by means of their location generally within the valve body 17 provide means for balancing the bias of spring 32 and the vapor pressure or capillary pressure in second compartment 52 of diaphragm chamber 48 which is in turn balanced by the pressure of the refrigerant in the inlet chamber 20 as communicated to the diaphragm 46 by piston 56 through follower 54.

The combination of the first and second push rods, the diaphragm, the follower and the piston, and the valve inlet chamber pressure and the capillary pressure communicating through these members and elements of the expansion valve, in concert with a pressure differential or pressure drop across the expansion valve, will result in balanced refrigerant flow such that refrigerant leaving the evaporator will have a determined amount of supeheat due to the expansion valve's balanced control of refrigerant flow.

The cross-sectional area of the piston 56 may be designed in order to provide an expansion valve with overcompensating or under compensating characteristics. Generally, if the piston cross-sectional area equals the cross-sectional area of the valve port 28, then the valve would be balanced and should neither overcompensate nor under compensate in response to changing pressure differential across the valve port. A piston with a cross-sectional area smaller than the cross-sectional area of the valve port will be underbalanced and generally under compensate for a change in pressure differential across the valve port. Similary, a piston with a cross-sectional area larger than the cross-sectional area of the valve port will be overbalanced and generally overcompensate for a change in pressure differential across the valve port.

Generally the bias force of the spring 32 may be varied to change the balance point of the expansion valve. Referring again to FIG. 2 it will be seen that a bearing plate 72 is operatively associated with the spring 32 providing the spring bias for valve guide 30. The plate 72 includes a plurality of flat faces 74 and the plate further includes an internal thread 76 and a first surface 78 against which the spring rests and a second opposing surface 80.

A rotatable plug 82 having a flange 84 is rotatable within an axial bore 96 of valve body 17. The plug includes a threaded post 106 threadably engaged with the internal thread 76 of plate 72, the plate and spring chamber bore 33 being compatibly configured such that rotation of the plug moves plate 72 up or down to either increase or decrease a spring force transmitted to the valve guide and therefore to the valve member and the follower 54, thereby changing the balance point of refrigerant flow through the expansion valve. The plug also includes a groove 88 for receiving a second O-ring 90. The second O-ring is provided in order to isolate the outlet chamber pressure from an ambient pressure. The plug includes a square head 92 for receivng a wrench used to rotate the plug so as to increase or decrease the spring pressure on the valve guide as desired.

The flange 84 is forced against a shoulder 94 which may be formed in the lower portion of valve body 17. The engagement maintains plug body 6 in its relative axial position by means of the spring force created by spring 32. A threaded cap 98 may be provided to cover the end of the plug extending out of the bottom of valve body 17.

One preferred embodiment of the balanced thermostatic expansion valve has been shown and described. However, it will be understood that variations are possible. For example, the piston and push rods may vary in shape and size to cancel or communicate the balancing forces between the various members so long as the piston and push rods do not substantially restrict or obstruct refrigerant flow through the expansion valve. Not substantially rstricting or obstructing refrigerant flow through the expansion valve becomes increasingly important to the overall operation of the expansion valve as the size of the expansion valve is reduced. It will be further understood that the preferred embodiment of the expansion valve has been described and illustrated herein and that the invention is not restricted to the illustrated members and their particular cooperating engagement.

Other modifications may be made to the embodiment illustrated and described without departing from the spirit of the invention. It is not intended that the scope of this invention be limited to a particular embodiment. Rather, the scope of the invention is to be determined by the following claims and their equivalents.

What I claim is:

1. In a refrigeration system having a compressor, condenser and evaporator operatively interconnected, a thermostatic expansion valve, comprising:

(a) a valve body, an inlet chamber, an outlet chamber and means for separating the inlet chamber from the outlet chamber, an inlet connecting the inlet chamber with a refrigerant line connected to the refrigeration system high pressure side, an outlet connecting the outlet chamber to a refrigerant line connected to the evaporator, (b) means for controlling the flow of the refrigerant through the expansion valve separating means, (c) means in the separating means for further defining a valve port which operatively receives the flow controlling means, the valve port providing communication between the inlet chamber and the outlet chamber for the flow of the refrigerant, (d) a biasing member for biasing the flow controlling means towards a closed position tending to close the valve port thereby reducing the flow of the refrigerant through the valve port, (e) a flexible motor element carried by the valve body and operatively connected to the flow controlling means for moving the flow controlling means between an open position and a closed position thereby increasing and decreasing the flow of the refrigerant through the valve port, (f) means for sensing a temperature at an evaporator outlet and subjecting one side of the flexible motor element to a pressure that is a function of the evaporator outlet temperature, (g) first communicating means for subjecting another opposing side of the flexible motor element to an inlet chamber pressure so as to tend to resist the movement of the flexible motor element in response to the temperature sensing means and counterbalance the force of the refrigerant flow tending to open the valve port, whereby the first communicating means sensing the inlet chamber pressure does not substantially restrict or obstruct refrigerant flow through the inlet chamber, the first communicating means including a piston having one free end located in the inlet chamber for sensing inlet chamber pressure without substantially restricting or obstructing refrigerant flow, and an opposing end operatively connected to the flexible motor element so as to communicate inlet chamber pressure to the other opposing side of the flexible motor element, (h) a second communicating means intermediate the flexible motor element and the biasing member for communicating a pressure difference to the biasing member, the pressure difference corresponding to a difference between the inlet chamber pressure and the pressure that is a function of the evaporator superheat, the second communicating means including a push rod intermediate the flexible motor element and the biased flow controlling means.

2. The expansion valve as set forth in claim 1 further comprising:

(i) the refrigerant flow controlling means including a valve member, (j) a valve seat located between the inlet chamber and the outlet chamber, (k) the valve port further defined by the valve seat.

3. The expansion valve as set forth in claim 2 wherein:

(l) the biasing member includes a spring.

4. The expansion valve as set forth in claim 1 further comprising:

(i) the flexible motor element including a diaphragm operatively mounted in a casing structure.

5. The expansion valve as set forth in claim 4, further comprising:

(j) a substantially rigid follower member intermediate the piston, push rod and the diaphragm.

6. The expansion valve as set forth in claim 1 further comprising:

(j) the push rod passes through a corresponding bore in the valve body, such that the flow of refrigerant through the expansion valve is not substantially restricted or obstructed.

7. The expansion valve as set forth in claim 1 further comprising:

(i) a cup seal in cooperative, sealing relationship with the first communicating means such that the greater the pressure of the refrigerant in contact with the cup seal the better the seal that is accomplished between the cup seal and the first communicating means.

8. The expansion valve as set forth in claim 7 further comprising:

(j) a TEFLON cup seal having a very low coefficient of friction.

9. In a refrigeration system having a compressor, condenser and evaporator operatively interconnected, a thermostatic expansion valve, comprising:

(a) a body, an inlet chamber, an outlet chamber and an intermediate threaded element, (b) a valve member, (c) a valve seat defining a valve seat port, (d) a casing structure threadably attached to the valve body, the casing structure including a diaphragm in a diaphragm chamber, the diaphragm dividing the chamber into one compartment and another compartment, a follower member attached to the diaphragm in the other compartment, (e) a fitting associated with the casing structure and providing means for applying a capillary pressure to one compartment of the diaphragm chamber, the capillary pressure communicating through a capillary tube from a bulb attached to a suction line of the refrigeration system, the bulb located so as to sense a suction line temperature or superheat, the capillary pressure applied to the one compartment of the diaphragm, (f) a valve guide located within the outlet chamber and biased towards a closed position of the valve seat port, a spring biasing the valve guide and valve member towards the closed position, (g) a threaded guide member threadably engaged with the body of the valve in a threaded bore providing a passage between the other diaphragm compartment and the inlet chamber, the threaded guide member including a flange cooperating with the valve body to limit threaded engagement between the threaded guide member and the valve body, the threaded guide member defining an axial bore providing another passage between the other diaphragm compartment and the inlet chamber with the threaded guide member threadably engaged with the threaded bore, (h) a piston located within the axial bore and movable within the bore without substantially restricting or obstructing refrigerant flow, (i) the follower intermediate the piston and the diaphragm in order to fully communicate the capillary pressure through the diaphragm and to the piston, (j) a first O-ring and a cup seal in sealing relationship with the threaded guide member so as to isolate direct communication between the inlet chamber and the other compartment of the diaphragm chamber, (k) a first push rod and a second push rod extending between the follower and the valve guide through a first and a second axial passage in the body such that the first and second push rods and piston are prallel to each other and communicate a difference between the inlet chamber pressure and the capillary pressure to the valve guide.

* * * * *

UNITED STATES PATENT AND TRADEMARK OFFICE

CERTIFICATE OF CORRECTION

PATENT NO. : 4,750,334

DATED : June 14, 1988

INVENTOR(S) : John G. Leimbach

It is certified that error appears in the above-identified patent and that said Letters Patent are hereby corrected as shown below:

Column 6, line 49, delete "6" and insert --86--.

Column 6, line 62, delete "rstricting" and insert --restricting--.

Signed and Sealed this

Twenty-fifth Day of October, 1988

*Attest:*

DONALD J. QUIGG

*Attesting Officer*

*Commissioner of Patents and Trademarks*